United States Patent [19]

Hamilton

[11] 4,142,262

[45] Mar. 6, 1979

[54] FLUSH TOILET SYSTEM

[76] Inventor: William H. Hamilton, 16769 32nd Ave., SW., Seattle, Wash. 98166

[21] Appl. No.: 812,066

[22] Filed: Jul. 1, 1977

[51] Int. Cl.[2] ..... E03D 3/10; E03D 1/22

[52] U.S. Cl. ..... 4/354; 4/362; 4/363; 4/370

[58] Field of Search ..... 4/26, 18, 18 A, 29, 4/30, 31, 35, 39, 40, 41, 38; 137/572, 628, 206

[56] References Cited

U.S. PATENT DOCUMENTS

| | | | |
|---|---|---|---|
| 2,190,773 | 2/1940 | Dunn | 4/40 |
| 3,344,439 | 10/1967 | Davies | 4/40 |
| 3,431,564 | 3/1969 | Davies | 4/40 |
| 3,605,125 | 9/1971 | Gibbs et al. | 4/40 X |
| 3,820,171 | 6/1974 | Larson | 4/31 |
| 4,044,407 | 8/1977 | Silcox | 4/40 |

*Primary Examiner*—Henry K. Artis

*Attorney, Agent, or Firm*—Strauch, Nolan, Neale, Nies & Kurz

[57] ABSTRACT

A water reservoir tank storing a primary body of water for release to a toilet bowl for flushing houses a pressure tank that stores a minor amount of water at a pressure considerably higher than that of the primary body and is discharged during flushing to join the water released from the reservoir tank and impart increased overall energy to the water in the bowl. The pressure tank is automatically discharged and recharged during each flushing cycle.

19 Claims, 11 Drawing Figures

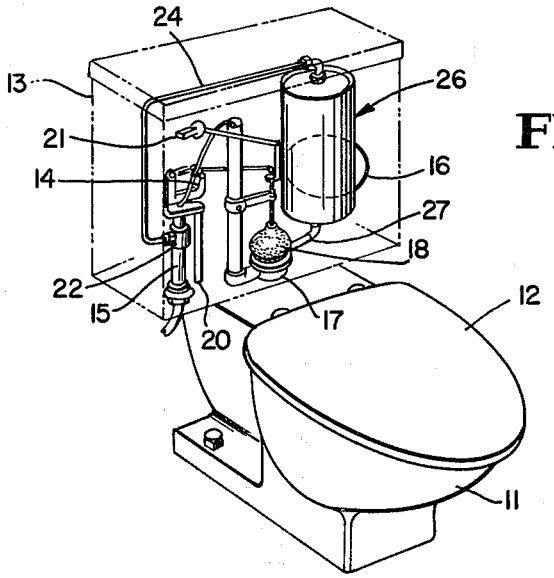
FIG. 1
FIG. 2
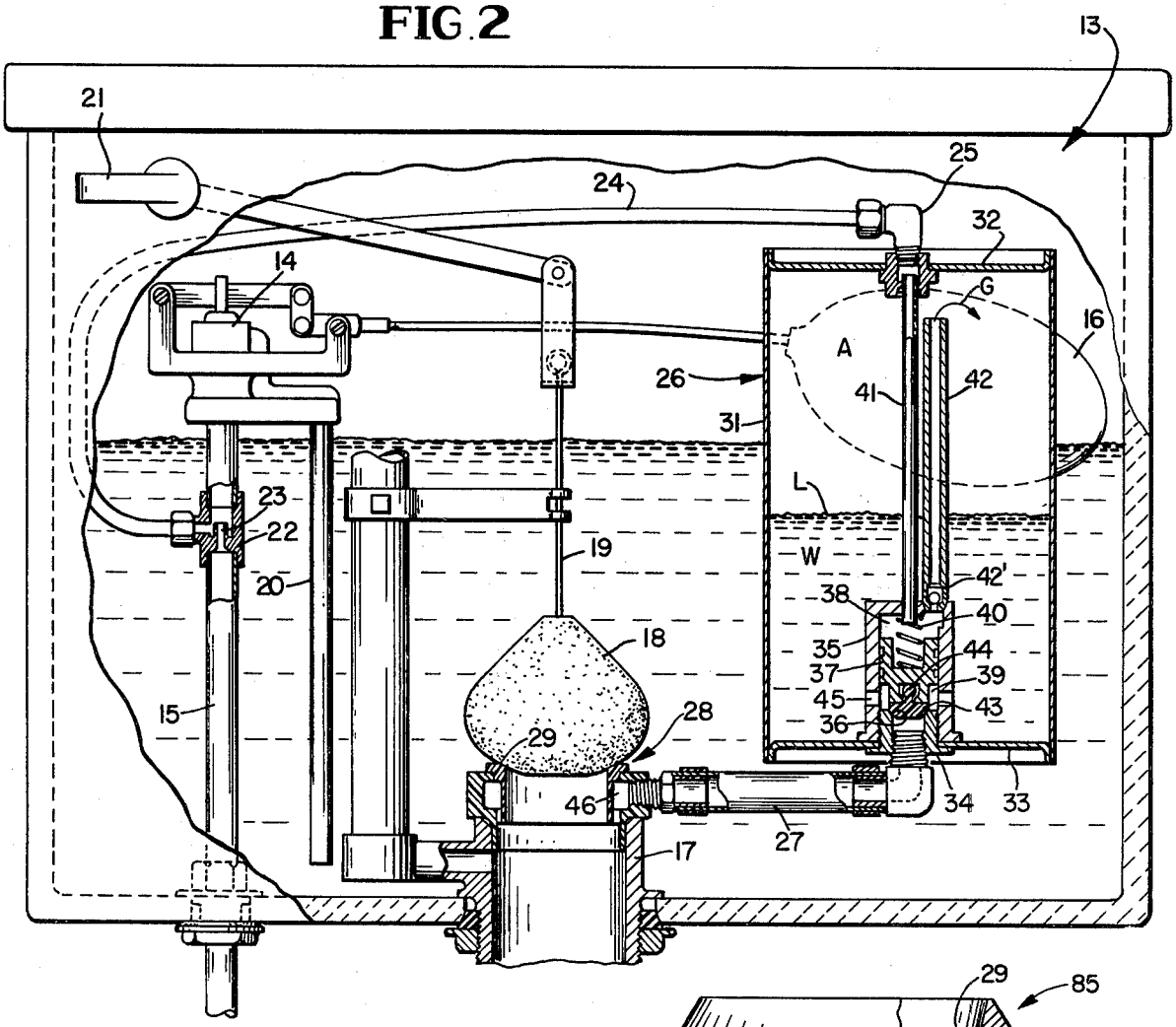
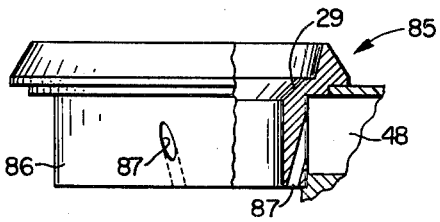
FIG. 10

FLUSH TOILET SYSTEM

This invention relates to a novel system for flush toilets of the type wherein a body of water stored in a reservoir tank is selectively released into a toilet bowl, and particularly to improvements therein enabling efficient flushing while using less water.

To obtain the flushing action of most conventional flush toilets, such as the usual household toilets, water under pressure is released into the toilet bowl creating the swirling velocity necessary to start the siphoning action and flush the standing water in the toilet bowl and its contents from the bowl to the drain. This pressure is conventionally obtained from the potential energy of a body of stored water which generally consists of five or more gallons of water stored at an elevation of approximately one foot above the toilet bowl. This system is wasteful and inefficient in that a relatively large quantity of water is required since the limited elevation of the stored water imparts only a relatively small amount of energy to the flushing water.

It has also been proposed to replace conventional household tanks with so-called hydraulic systems having sealed tanks wherein a body of water is stored at substantially intake mains pressure and released. In such systems air is compressed within a storage tank by inlet water from the supply mains which may have pressures up to one hundred pounds per square inch, and when the tank discharge is effected the expanding air rapidly expels the water from the tank into the toilet bowl. A savings in water usage has been alleged for this type of system. Reference is made to U.S. Nos. 2,658,203; 3,397,408; 3,677,294; 3,817,279; 3,817,286 and 3,820,171 which disclose such hydraulic systems.

As will be observed one of the practical difficulties attendant these hydraulic systems is that for existing installations the usual household storage tank, which is normally regarded as a lifetime component, must be discarded and replaced by a special sealed tank having the required volume. This makes conversion expensive, and the large sized sealed tanks required for both conversion and original installations are expensive.

In the system of the present invention, a stored body of water is released toward the toilet bowl as in the aforesaid conventional household systems and at the same time additional energy is imparted thereto to increase the efficiency of flushing while utilizing less water overall than in the conventional system, and this is a major object of invention.

Thus in the system of the invention the major components of the conventional system may be retained and there is a minimum of modification thereby reducing expense. By the same token the invention may be incorporated into new installations using conventional type components, thereby advantageously using existing inventories.

Another object of the invention is to provide a novel flush toilet system wherein during flushing a primary body of stored water is discharged for gravity flow to the toilet bowl and during such discharge is further energized by the introduction thereinto of a relatively small amount of water at higher velocity.

It is a further object of the invention to provide a novel flush toilet system comprising a primary water storage tank having a water level control such as a float controlled water inlet valve and a discharge valve, and a pressure tank that is automatically recharged with water at substantially inlet mains pressure during each flushing cycle, together with an arrangement whereby water is automatically discharged at high velocity from the pressure tank into the water descending from the primary water body after the tank discharge valve opened.

It is a further object of the invention to provide a novel flush toilet system having a primary water storage tank having a discharge valve at its outlet, a pressure tank for containing water under pressure, a conduit connecting the outlet of said pressure tank to the outlet of said primary tank, and means including control valve means responsive to a flush operation initiated by opening said discharge valve for sequentially expelling water from said pressure tank through said conduit and then recharging the pressure tank.

Pursuant to the foregoing object; novel structures for carrying out the invention are contemplated including the provision of a passage such as a conduit extending from a venturi region in the inlet water pipe to the control valve in the pressure tank, a special piston actuated control valve at the pressure tank, and various nozzle forms at the discharge valve of the primary tank.

Further novel features and other objects of this invention will become apparent from the following detailed description discussion and the appended claims taken in conjunction with the accompanying drawings.

BRIEF DESCRIPTION OF DRAWINGS

FIG. 1 is a generally perspective somewhat diagrammatic view illustrating the invention in its preferred environment;

FIG. 2 is a side elevation, partly broken away and partly sectioned, illustrating detail of the invention according to a preferred embodiment;

FIG. 10 is an elevation partly in section showing another nozzle form.

PREFERRED EMBODIMENTS

Figure 3:
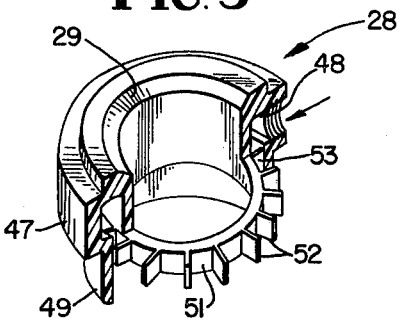
FIG. 3 is a generally perspective view showing a form of nozzle for discharging water from the pressure tank.

FIG. 1 shows a flush toilet assembly having a bowl 11 that may be closed by cover 12, and a flush water reservoir tank 13 in the form of a rectangular porcelain or metal tank. A float operated intake valve 14 is mounted at the upper end of a water intake pipe 15, and a valve 14 having an outlet 20 into tank 13 is connected by a rod to float 16. The water pressure in pipe 15 is normally that of the supply mains, between 30 and 100 pounds per square inch and normally about 60 pounds per square inch. Float 16 acts to close intake valve 14 when there is a certain water level in tank 13. At the bottom of tank 13 is a tank outlet fixture 17 through which water from the tank is discharged into the bowl when valve 14 is opened and the toilet is flushed. From the lower end of fixture 17 there may be any conventional distribution of the water around and into the bowl.

A ball valve element 18 is adapted to seat upon by gravity and normally close the upper end of tank outlet fixture 17, thereby serving as a tank discharge valve, and ball 18 may be attached to a cable or rod 19 leading to an external handle such as 21, whereby when it is desired to flush the toilet the operator merely pulls ball 18 up off its seat to start discharge of the contents of the tank. As the water level in tank 13 recedes, the float opens valve 14 and the tank starts to fill but of course at a much slower rate than the discharge at 17. The released valve element 18 descends by gravity eventually reseating on fixture 17 to stop discharge into the bowl altogether and allow the water in the tank to regain its certain level at which time intake valve 14 closes.

The foregoing structure and operation may be conventional and in fact as will appear the parts introduced according to the invention may readily convert a conventional flush toilet structure to the invention.

In the invention as illustrated in FIG. 2 the water intake pipe 15 is modified below the float valve 14 to incorporate a venturi section 22 wherein the internal pipe diameter is reduced at 23 for increased flow velocity and localized lower fluid pressure for a purpose to appear. An inlet tube 24 extends from venturi section 22 to a fitting 25 in the upper end of a sealed pressure tank 26. An outlet conduit 27 extends from the bottom of pressure tank 26 to an annular nozzle assembly 28 on outlet fixture 17, an inclined annular seat 29 being provided on the nozzle assembly for normally seating reservoir tank discharge valve element 18. Conduit 27 is relatively rigid and may provide the main support for pressure tank 26, so that for a known dimension toilet unit the inlet tube 24, pressure tank 26, outlet conduit 27 and nozzle assembly 28 may be preassembled prior to introduction as a unit into the reservoir tank 13.

Pressure tank 26 has a cylindrical side wall 31 sealed pressure tight to a top wall 32 where fitting 25 enters and a bottom wall 33 where outlet conduit 27 is attached to a fitting 34. A control valve comprises a valve actuator cylinder 35 secured to the inner end of fitting 34 which extends up into the tank and provides an annular frusto-conical valve seat 36. A piston 37 is vertically slidable in cylinder 35 in which it defines an upper water intake space 38 and a lower water discharge space 39.

Tube 41 which is an effective continuation of inlet tube 24 extends from fitting 25 down to space 38, and a standpipe 42 containing a check valve 42' extends from the upper wall of cylinder 35 to provide a unidirectional outlet from space 38 as indicated by the arrow G. As shown the upper discharge end of standpipe 42 is advantageously above the waterline within the cylinder. A control valve element 43 is mounted on the lower end of piston 37 and is formed to seat onto conical seat 36. Preferably element 43 has a relatively loose ball and socket connection 44 with piston 37 so that it is self centering for full closure engagement on seat 36 when the piston descends. A light compression spring 40 may be provided in space 38 to bias piston 37 toward valve closed position, but this spring may be omitted in some installations, as a pressure differential across the valve piston may provide the necessary operation as will appear.

A plurality of openings 45 in the cylinder wall provide constant communication of space 39 with the lower interior of pressure tank 26.

As shown in FIG. 3, nozzle assembly 28 may comprise an integral annular member 47 having an internal annular chamber 48 into which opens the end of pressure tank outlet conduit 27. An outer depending skirt 49 on member 47 fits telescopingly within the upper end of fixture 17, and an inner depending skirt 51 on member 47 is radially spaced from skirt 49 and formed with a series of circumferentially spaced water deflection blades 52 projecting outwardly toward skirt 49. As shown, the bottom of chamber 48 is formed with an annular opening 53 from which water may flow through the space containing blades 52. Blades 52 may be tilted at any desired angle to the axis of the nozzle assembly for imparting desired directional swirl and turbulence to the water discharged from the nozzle assembly for a purpose to appear. Valve seat 29 is formed around the upper inner periphery of member 47.

Figure 4:
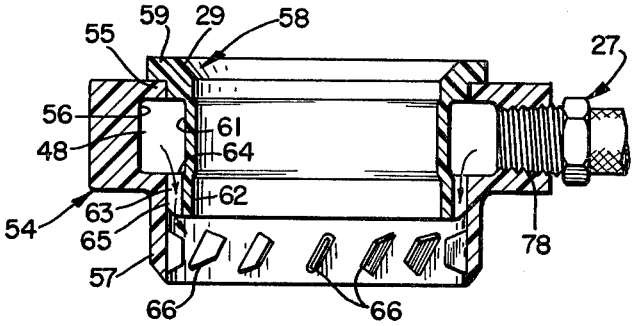
FIG. 4 is a section showing another type of nozzle structure.
Figure 5:
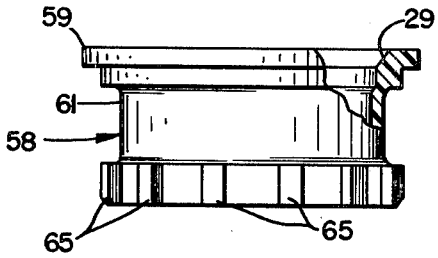
FIG. 5 is a side elevation partly broken away and in section showing one nozzle member of FIG. 4.
Figure 6:
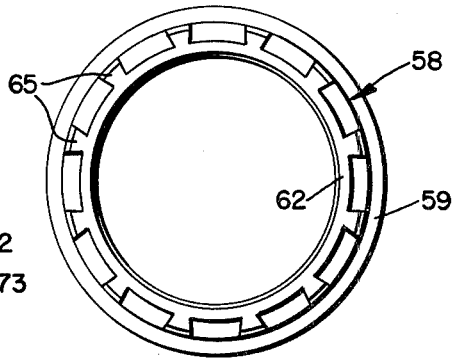
FIG. 6 is a bottom plan view of said one nozzle member of FIG. 4.

Another closely related form of nozzle assembly 28 is shown in FIGS. 4–6.

Here nozzle assembly 28 also comprises the annular chamber 48 into which opens the end of outlet conduit 27, but the nozzle assembly is in two parts and consists of an outer annular member 54 having an upper rim 55 below which is an annular radially inwardly facing recess 56 and a depending annular skirt 57. The inner member 58 of the nozzle assembly is an annulus that telescopes within member 54, being formed with an upper ledge 59 that seats on rim 55, an annular radially outwardly facing recess 61 that is opposite recess 56 to define therewith the annular chamber 48, and a depending annular skirt 62 that is spaced from skirt 57 to provide an annular space 63 in alignment with one or more openings 64 in the bottom of chamber 48. A series of circumferentially spaced generally radial water deflection blades 65 extend outwardly from skirt 62 into space 63. If desired a series of further water deflecting raised formations 66 may be formed around the interior of skirt 57 below blades 65, or blades 65 may be omitted and formations 66 structured to provide the desired swirl and turbulence to water passing through the nozzle assembly. Valve seat 29 is formed around the upper end of member 58.

In operation of the embodiment of FIGS. 1–6, assume a starting condition wherein valve ball 18 is seated at 29 to close the reservoir tank discharge valve and water at mains pressure enters through pipe 15 and valve 14 until the reservoir fills to a certain level so that float 16 causes valve 14 to close. At this point there is no water in the pressure tank 26.

After closure of intake valve 14, inlet water that is blocked by valve 14 flows now at mains pressure through tube 24 into pressure tank 26. Thus water from tube 41 at inlet mains pressure enters control valve cylinder space 38 from which it exits through check valve 42' and standpipe 42 into pressure tank 26. Piston 37, which is already urged toward its lower control valve closing position by gravity, and by spring 40 if present, is even further biased in that direction by the inlet water pressure in space 38 to close the control valve. Water continues to accumulate within pressure tank 26 toward a level therein indicated at L, while gradually compressing the air trapped in the upper part of the cylinder. The water body in pressure tank 26 is indicated at W, and the compressed air body at A. When the water level reaches L, air in body A has been compressed to the extent that its pressure is equal to the water intake pressure of water body W, and flow of water into the pressure tank 26 ceases. The amount of water in body W now in the pressure tank is minor as compared to that in tank 13, preferably being only about 15 percent that of tank 13. The compressed body of air at A is now essentially an air spring resiliently acting against the water body W.

At this point the whole system is in equilibrium and there is no water flow. However the system is ready for operation according to the invention since pressure tank 26 is charged for action.

When the toilet bowl is to be flushed, the operator unseats ball valve 18 in the usual way and releases handle 21. This starts the usual downward flow of water under the pressure head of tank 13 through fitting 17. At about the same time as the reservoir water level recedes valve 14 is opened by the float and water at inlet mains pressure flows up pipe 15 through valve 14 to enter tank 13. This intake of water is as conventionally only minor as compared to the sudden large volume discharge through the outlet at 17. An immediate low pressure region is established in the venturi fitting at the junction of pipe 15 and tube 24, creating essentially a suction effect in tube 24 tending to cause a reverse water flow in tube 24 and water flow out of space 38, to immediately reduce the fluid pressure in space 38 to a point where the pressure differential across piston 37 arising from the water pressure to space 39 aided by the atmospheric pressure available through conduit 27 acting on its lower side and the reduced pressure of space 38 acting on its upper side causes immediate upward displacement of piston 37 to unseat the valve element 43. Spring 40 when used is light enough to offer no effective resistance to this action. In some installations spring 40 might be eliminated, and actually a light biasing spring placed in space 39 to ensure prompt opening movement of the valve piston and eliminate valve sticking. Water from the pressure tank is now discharged at relatively high velocity through conduit 27 due to the pressure exerted by the now expanding air body A.

As it passes through nozzle assembly 28, the high velocity water from the pressure tank intersects and joins the water descending at the lower tank head pressure through the interior of nozzle assembly 28, and the added energy accompanied by the blade controlled direction of the high velocity water imparts swirl and turbulence to the greater mass of reservoir tank water reaching the bowl. The kinetic energy of the high velocity water from the nozzle adds to the pressure head energy of the column of water descending from the reservoir tank to increase the overall energy of the flushing water whereby an increased and improved flushing of the bowl is attained.

After the ball 18 descends and is again seated to close the reservoir tank discharge valve and while reservoir tank 13 is refilling, the control valve is held open by the differential pressure across the piston caused by pressure in space 39 and suction in space 38. This allows air in the pressure tank to return to atmospheric pressure before the pressure tank is recharged. Pressure tank 26 is automatically recharged as above explained and the system is again in equilibrium awaiting the next flush.

Locating of the standpipe outlet above the water level in the pressure tank 26 serves as an anti-siphon arrangement so that in the event there is suction in the mains or there is a failure of valve 42, only air would be siphoned back through tube 24.

The proportions of the parts and the timing are such that the high velocity jet-like flow of water through the blades of nozzle assembly 28 takes place only a very short time after the primary body of water starts to leave reservoir tank 13 and discharges through the interior of the nozzle assembly whereby at least a considerably major amount of the descending reservoir water is subjected to the increased turbulence. The result is that the toilet bowl may be more effectively flushed and cleaned with less water from the reservoir tank, and the invention thereby enables the float controlled water level in reservoir tank 13 to be set much lower than previously considered possible for efficient action. A tremendous water saving is thereby obtained with the invention with results at least equal to and usually better than conventional systems using much more water for flushing.

Thus in the invention, each time the toilet is flushed the pressure tank 26 acts automatically to increase swirl and turbulence in the flush water and then will be automatically recharged, ready to be actuated in the succeeding flush operation. The operator needs do nothing more than in prior conventional systems.

Figure 7:
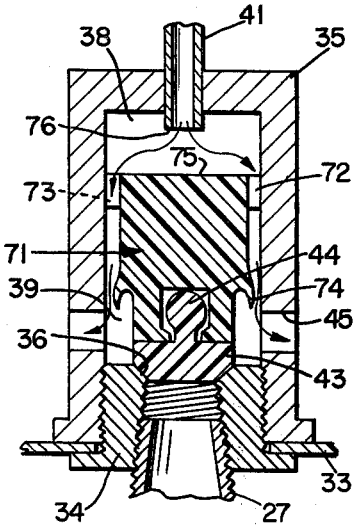
FIG. 7 is a fragmentary view showing another form of control valve in the position it occupies as the pressure tank is being energized.
Figure 8A:
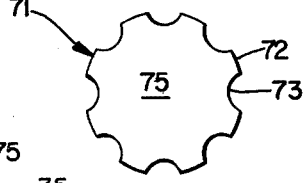
FIG. 8A is a top plan view of a modified view actuator piston.
Figure 8:
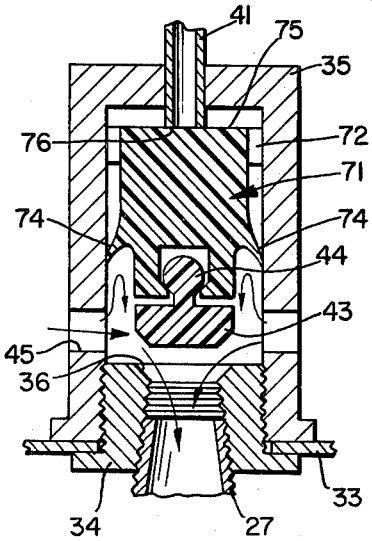
FIG. 8 is a fragmentary view similar to FIG. 7 showing the control valve position during discharge of water from the pressure tank.

Referring to FIGS. 7 and 8, another form of control valve in the pressure tank is shown, all other parts being as disclosed in FIGS. 1–6. In this embodiment the valve piston 71 is an integral element that separates the interior of the valve cylinder 35 into the spaces 38 and 39, but in the valve closed condition a different flow of water is provided between inlet tube 41 and the interior of cylinder 31. This is accomplished by providing a special piston 71 of mainly less diameter than the interior of cylinder 31 having a cylindrical flange 72 in sliding contact with the cylinder wall and longitudinal recesses or openings 73 through the flange.

Piston 71 which is preferably a molded element of synthetic rubber is formed with a resilient peripheral lip 74 which, when subjected to inlet water pressure in the closed control valve condition of FIG. 7, is flexed to open position, thereby enabling the water entering at inlet pressure from tube 41 to flow directly through space 38, openings 73, the space around the piston, space 39 and cylinder wall openings 45 into the lower part of the pressure tank. The loosely mounted self centering valve element 43 is the same as in FIG. 1.

When the system operation above described changes the fluid pressure effective through tube 41 to suction in space 38, piston 71 snaps upwardly until its flat upper face 75 engages and seals shut the planar lower end 76 of tube 41 as shown in FIG. 8. This is due to the fluid pressure differential across the piston the bottom of which is exposed to atmospheric pressure at this point. The control valve thus opens. Now the water body W discharges at high velocity through openings 45 and the open control valve and the fluid pressure in space 39 is effective to flex lip 74 outwardly to engage the cylinder wall and thereby seal against backward flow of water toward space 38.

This modification dispenses with the check valve 42 of FIG. 1, and it may or may not employ a light valve closure piston biasing spring similar to spring 40 in FIG. 1.

Figure 9:
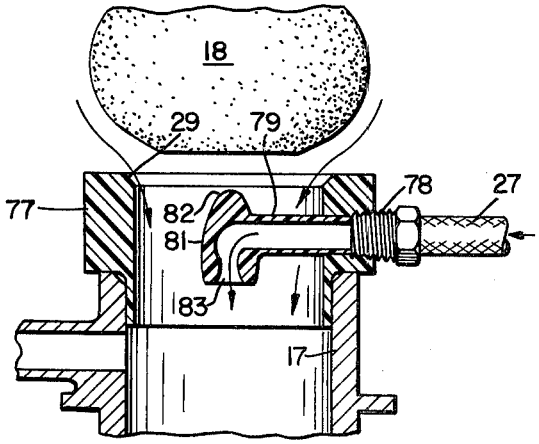
FIG. 9 is a fragmentary sectional view illustrating another form of nozzle.

FIG. 9 shows another form of turbulence imparting nozzle assembly wherein an annular member 77 is mounted on the upper end of fixture 17 and formed with valve seat 29 for cooperation with the ball valve element 18. Here the outlet conduit 27 from the pressure tank is connected by a fitting 78 to a radially inwardly projecting nozzle member 70 that terminates in a downwardly open nozzle terminal 81 that is substantially centered with the reservoir tank discharge opening defined by member 77. Preferably terminal 81 is streamlined as indicated at 82 opposite opening 83, to offer minimum resistance to water flow. During operation, which except for the nozzle action is the same as in the other embodiments, the high velocity water stream adds its energy to and causes turbulence in the descending water column from the reservoir, particularly in some forms of bowl where a ledge or the like may extend inwardly just below fixture 17.

The nozzle 85 shown in FIG. 10 illustrates another mode of imparting turbulence to the water being discharged through fitting 17. As in FIGS. 3 and 4 the annular chamber 48 receiving water under pressure from tank 26 is provided around the nozzle skirt 86 in communication with a series of circumferentially spaced bores 87 drilled through the skirt. As shown these bores are inclined downwardly and inwardly at a suitable angle, such as 15°, to the nozzle axis, and also inclined laterally in the same direction at a suitable angle, such as 15° relative to the nozzle axis. The effect of this is to impart a positive swirling action to water descending through the nozzle during flushing.

The invention provides great economic advantages coupled with readiness of adaptation to existing toilet assemblies.

Since the pressure tank is relatively small it will fit conveniently into most conventional toilet reservoir tanks. Its relatively small size allows it to be fabricated economically from aluminum or plastic materials and still give it the pressure capability necessary to meet existing plumbing codes.

The system of the invention is just as quiet as conventional toilet flushing, and flushing is accomplished in a shorter time period.

The control valve assembly embodiment with the foregoing check valved arrangement completely isolates the fill water from the pressure tank, preventing any back flow or siphoning. This feature facilitates meeting standard plumbing codes.

The system of the invention should be readily accepted by most householders as well as hotel, motel and apartment house landlords because of its low cost and convenient installation. No changes to any of the major components of an existing toilet assembly are required. It can be installed by homeowners as well as professional plumbers.

It is estimated that the average householder may pay for the cost of the installation of the invention in less than one year through the savings in water costs. Aside from the favorable economics for the householder, the savings in municipal water systems and sewage systems will be considerable.

With today's emphasis on water conservation, economic and social pressures are favorable towards adoption. It is estimated that if 70% of the gravity flow toilets in the United States installed the system of the invention, there could be a savings of over a billion gallons of water per day.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a flush toilet system having a bowl, a reservoir tank wherein water may be stored in a primary body at a predetermined level to establish a predetermined pressure head and means for selectively releasing water from said tank into the bowl during flushing, the provision of means within said reservoir tank operative when water is released from said reservoir tank for automatically discharging a predetermined quantity of water from a source wherein water is contained at a pressure higher than the pressure of the water in the reservoir tank into water being released from said tank into said bowl at sufficiently high velocity to materially increase the overall energy of the water in the bowl and effect increased efficiency during flushing.

2. In the flush toilet system defined in claim 1, said predetermined quantity of water being minor as compared to the amount of water stored in said reservoir.

3. In the flush toilet system defined in claim 1, said last named means comprising a pressure tank and means whereby said predetermined quantity of water is stored in said pressure tank under a pressure appreciably higher than the pressure of the water in said reservoir tank and control valve means whereby water is automatically discharged from the pressure tank during release of water from said reservoir tank.

4. In the flush toilet system defined in claim 3, a supply line containing water at mains pressure connected by intake valve means to said reservoir tank, and means providing a passage between said pressure tank and said supply line upstream of said intake valve means whereby water at mains pressure may be introduced into said pressure tank when said intake valve means is closed.

5. In the flush toilet system defined in claim 4, said pressure tank being a sealed tank mounted within the reservoir tank and said passage being a tube connected at opposite ends to the supply line and pressure tank.

6. In the flush toilet system defined in claim 4, means whereby said pressure tank is recharged with water at said higher pressure as a sequence in the flush cycle following a bowl flushing operation.

7. In a flush toilet system having a bowl, a reservoir tank wherein water may be stored in a primary body at a predetermined level to establish a predetermined pressure head and means for selectively releasing water from said tank into the bowl during flushing, the provision of a water intake pipe extending into said reservoir tank to a water level controlled intake valve having an outlet to said tank, means providing a reduced fluid pressure region in said pipe, and means operative when water is released from said reservoir tank for automatically discharging a predetermined quantity of water into water being released from said tank into said bowl at sufficiently high velocity to materially increase the overall energy of the water in the bowl and effect increased efficiency during flushing comprising a sealed pressure tank, a passage connecting said reduced pressure region to said pressure tank, an outlet conduit connected at one end to said pressure tank and connected at its other end to nozzle means through which said primary body of water is released, and a control valve in said pressure tank responsive to fluid pressure transmitted through said passage to open or close the outlet conduit at said one end.

8. In the flush toilet system defined in claim 7, said control valve comprising a piston element closing said outlet conduit when the system is idle and movable in response to fluid pressure differential thereacross between said conduit closing position and a conduit open position wherein water is discharged from the pressure tank.

9. In the flush toilet system defined in claim 7, said control valve comprising a cylinder having an annular valve seat in its lower portion located at said one end of the outlet conduit, a piston slidable in said cylinder and carrying a valve element adapted for coacting with said annular seat, said passage comprising a tubular end section extending into the cylinder space above said piston, water under pressure entering said cylinder from said passage serving to urge said piston downward to move said valve element to control valve closed position on said annular seat, and means whereby water under pressure entering the cylinder while said control valve is closed is directed into the pressure tank to be stored therein until air and water pressures are equalized in said pressure tank, aperture means in the cylinder wall connecting the space below said piston to the interior of said pressure tank, and means effective when water from the reservoir tank is released to discharge through said nozzle means and said water level controlled intake valve opens for creating reduced fluid pressure in said passage and at the upper end of said piston whereby said piston is displaced upwardly to open said control valve and allow water under pressure from the pressure tank to be expelled through said cylinder wall aperture means to said outlet conduit.

10. In the flush toilet system defined in claim 9, there being a check valved opening in the upper cylinder wall whereby water under pressure from the cylinder space above said piston may directly enter said pressure tank when the control valve is closed.

11. In the flush toilet system defined in claim 9, said piston being provided with check valved bypass means whereby water under pressure may be directed into the cylinder space below said piston and through said cylinder wall aperture means into the pressure tank when the control valve is closed.

12. In the flush toilet system defined in claim 11, said check valved bypass comprising a flexible skirt on said piston that is forced away from the cylinder wall when water under pressure enters through said passage, and is forced into sealing engagement with the cylinder wall when said piston is displaced upwardly to control valve open position and water is being discharged from the pressure tank.

13. In the flush toilet system defined in claim 10, said piston upper end being constructed and arranged to close the end section of said passage when the piston is in its upwardly displaced control valve open position.

14. In the flush toilet system defined in claim 7, said nozzle means comprising an annular member having an annular seat coacting with a manually operable discharge valve element for controlling release of water from said reservoir tank, means defining an annular water distribution chamber in said member connected to said other end of said outlet conduit, and means for deflecting water leaving said chamber into predetermined swirl and turbulence imparting association with said released water from the reservoir tank passing through said nozzle means.

15. In the flush toilet system defined in claim 14, said deflector means comprising a series of angled blades in the water path.

16. In the flush toilet system defined in claim 7, said nozzle means comprising an annular member having an annular seat coacting with a manually operable discharge valve element for controlling release of water from said reservoir tank, and means providing a continuation of said outlet conduit extending substantially radially into the central portion of said member and formed with a downwardly open discharge head in the path of water released from said reservoir tank.

17. In the flush toilet system defined in claim 14, said means for deflecting water leaving said chamber comprising means providing in said member a plurality of circumferentially distributed inclined bores in the water path.

18. In a flush toilet system having a bowl, a reservoir tank wherein water may be stored in a primary body at a predetermined level to establish a predetermined pressure head and means for selectively releasing water from said reservoir tank into the bowl during flushing, the provision of water intake pipe means having a portion extending into said reservoir tank to a water level controlled intake valve having an outlet to said tank, means effective while water is flowing through said pipe means and said intake valve is open for providing a reduced fluid pressure region in said pipe means, and means operative in predetermined timed relation to release of water from said reservoir tank for automatically discharging a predetermined quantity of water into water released from said tank into said bowl at sufficiently high velocity to materially increase the overall energy of the water in the bowl and effect increased efficiency during flushing comprising a sealed pressure tank, a passage connecting said reduced pressure region to said pressure tank and through which water may flow from said pipe means to said pressure tank when said intake valve is closed, an outlet conduit connected at one end to said pressure tank and connected at its other end to discharge water from said pressure tank into said bowl to join water released from said primary body of water, and a control valve in said pressure tank responsive to fluid pressure transmitted through said passage to open or close theoutlet conduit at said one end, said control valve being opened when fluid pressure in said passage is reduced to a predetermined value.

19. In the flush toilet system defined in claim 18, said reduced pressure region being a venturi section in said pipe means, and said passage comprising a conduit connected at one end to said venturi and at its other end to said control valve.

* * * * *